United States Patent [19]

Petrini et al.

[11] Patent Number: 4,555,830

[45] Date of Patent: Dec. 3, 1985

[54] ADJUSTMENT DEVICE FOR A SKI BOOT

[75] Inventors: Roland Petrini, Chambéry; Jean-Louis De Marchi, Duingt, both of France

[73] Assignee: Salomon S.A., Annecy, France

[21] Appl. No.: 615,637

[22] Filed: May 31, 1984

[30] Foreign Application Priority Data

May 31, 1983 [FR] France ..... 83 08986

[51] Int. Cl.[4] ..... A43C 11/00

[52] U.S. Cl. ..... 24/68 SK; 24/19; 24/69 SK; 24/70 SK; 24/71 SK; 351/156

[58] Field of Search ..... 24/68 SK, 69 SK, 70 SK, 24/71 SK, 274 R, 20 R, 20 S, 19, 549, 584; 2/8; 351/156

[56] References Cited

U.S. PATENT DOCUMENTS

| | | | |
|---|---|---|---|
| 235,271 | 12/1880 | McWatters | 24/68 SK |
| 357,287 | 2/1887 | Nolte | 24/68 SK |
| 2,205,741 | 6/1940 | Bowers | 351/156 |
| 2,205,742 | 6/1940 | Bowers | 351/156 |
| 2,907,086 | 10/1959 | Ord | 24/19 |
| 2,926,406 | 3/1960 | Edwards et al. | 2/8 |
| 3,035,319 | 5/1962 | Wolff | 24/19 |
| 3,090,046 | 5/1963 | Bowers, Sr. | 2/8 |
| 3,214,809 | 11/1965 | Edwards | 351/156 |
| 3,662,435 | 5/1972 | Allsop | 24/70 SK |
| 3,729,779 | 5/1973 | Porth | 24/68 SK |

FOREIGN PATENT DOCUMENTS

| | | | |
|---|---|---|---|
| 3222383 | 1/1983 | Fed. Rep. of Germany | 24/69 SK |

*Primary Examiner*—Victor N. Sakran

*Attorney, Agent, or Firm*—Pollock, Vande Sande & Priddy

[57] ABSTRACT

A device for progressively adjusting the relative positions of two elements, comprising a rack (5), a control knob (4) rotatably mounted on a support (3) above the rack and having its lower face turned toward the latter, a spiral rib (15) centered on the rotational axis (xx') of the control knob and the spiral rib, which axis is inclined with respect to the plane of the rack. The device is applicable to the tightening of ski boots.

8 Claims, 4 Drawing Figures

ADJUSTMENT DEVICE FOR A SKI BOOT

SUMMARY OF THE INVENTION

The present invention relates to a device for progressively adjusting the relative positions of two elements, and in particular for adjusting the tension of a connecting element used in a tightening device mounted on a ski boot.

BACKGROUND OF THE INVENTION

Progressive tightening devices causing the relative displacement of two elements are already known. In these devices, one of the elements can be considered as fixed and the other as movable, the object being to vary progressively the tension of the movable element, and thereby the tightening force. A device of this type is disclosed, e.g., in U.S. Pat. No. 2,205,742, and comprises a pinion permanently engaged, by diametrically opposite teeth, with the teeth of two parallel racks which are driven in opposite directions upon rotation of the control pinion. Such a device has the disadvantage of a relatively complex structure, and, in view of its reversability, does not provide absolute assurance of safety. In other words, it is necessary to supplement it with a locking device in order to maintain the pinion firmly in a position corresponding to a given tension adjustment, if untimely disadjustment is to be avoided.

OBJECT OF THE INVENTION

The present invention is intended to overcome these disadvantages by providing a particularly simple adjustment device enabling adjustment over a wide range, with the assurance of irreversability of the selected adjustment.

To this end, the present device comprises a support integral with one of the two elements whose relative positions are to be adjusted, a rack formed of a succession of teeth of constant pitch solid with the second element and engaged in the support, a control knob rotatably mounted on the support above the rack and with its lower face turned toward the latter, and a spiral rib centered on the rotational axis of the control knob, this spiral rib extending over an arc of at least 360° and having a pitch, i.e., an interval between turns, equal to that between the teeth of the rack. The rotational axis of the control knob and of the spiral rib are inclined, with respect to the plane of the rack, at an angle such that, no matter what the position of the spiral rib, a small portion of the latter is engaged between two successive teeth of the rack, while the diametrically opposite portion of the rib is located above the plane passing through the crests of the rack teeth.

The adjustment device according to the invention has the advantage that, because the rotational movement of the control knob is transformed into a translational movement of the rack through the cooperation of the spiral rib with the teeth of the rack, it is perfectly irreversible, and hence cannot be changed to whatever adjustment may result from exerting, e.g., relative traction between the two elements. Moreover, the range of adjustments which can be obtained by means of the device according to the invention is remarkably wide due to the inclination of the spiral rib, the result of which is that only a small portion of the latter is in engagement with the teeth of the rack, while the diametrically opposite portion does not interfere to any extent with the sliding of the rack.

BRIEF DESCRIPTION OF THE DRAWINGS

In order that the invention may be more clearly understood, reference will now be made to the accompanying drawings, wherein several embodiments of the invention are shown for purposes of illustration, and wherein.

DESCRIPTION OF PREFERRED EMBODIMENT

Figure 1:
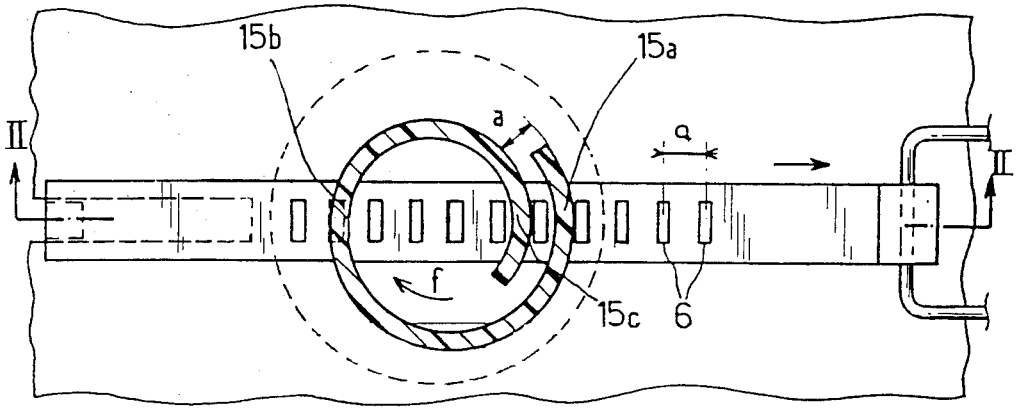
FIG. 1 is a plan view of an adjustment device according to the invention, the housing forming the support for the rotatable control knob being omitted.

As illustrated in the drawings, the two elements whose relative positions are to be adjusted comprise a base plate 1 and a flexible connecting element 2. The base plate may be, for example, a portion of a ski boot, and the connecting element may be attached, at its end (not shown) to any element to be displaced with respect to portion 1 of the ski boot.

A housing 3 constituting a support for a rotatable control knob 4 is attached to base plate 1. This control knob 4 acts on a rack 5 constituted by a bar coupled, at its right-hand end, to connecting element 2. On its upper face, rack 5 has a succession of teeth 6 separated from one another by a uniform distance a. At its left-hand end, rack 5 may have, on its lower face, a flange 7 sliding in a slot 8 of base plate 1, and abutting against the end of said slot 8 so as to limit the path of travel of rack 5.

Figure 2:
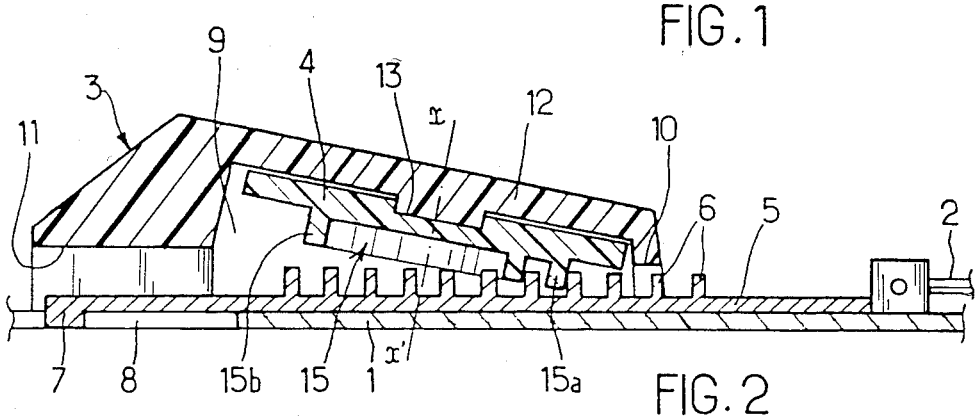
FIG. 2 is a longitudinal and vertical section view along line II—II of FIG. 1.
Figure 3:
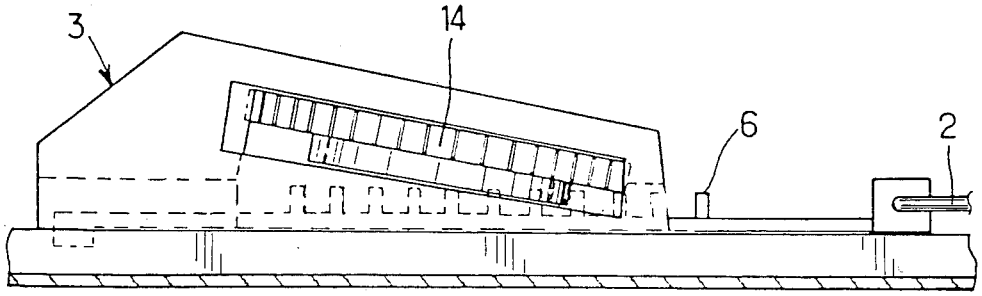
FIG. 3 is an elevation of the adjustment device.

In its central portion, housing support 3 has a recess 9 in which control knob 4 is rotatably mounted, this recess communicating with the exterior through openings 10 and 11 through which passes longitudinally rack 5 sliding on the upper face of base plate 1. Housing 3 also has an upper wall 12 which is preferably downwardly inclined in its entirety toward the base from left to right as seen in FIGS. 2 and 3. On its lower face, upper wall 12, which is inclined with respect to the plane of rack 5, has a central projection 13 acting as a pivot for control knob 4. Axis xx' of this central projection is inclined with respect to rack 5 and forms with the latter an acute angle, axis xx' being inclined toward the right, in the direction of connecting element 2.

Rotatable control knob 4 has a knurled peripheral surface 14 which projects laterally with respect to the support housing and which thus enables control knob 4 to be rotated.

Control knob 4 is coupled to rack 5 through the intermediary of a rib 15 formed on its lower face and extending in a spiral centered on rotational axis xx' of control knob 4. This spiral rib extends in an arc of at least 360° and, in the illustrated example, comprises a little more than a complete spiral, as may be seen in FIG. 1.

The pitch of spiral rib 15, i.e., the distance between the outer and inner faces of two turns, is equal to the spacing between the teeth of rack 5.

As may be seen in FIG. 2, the angle of inclination of axis xx' of knob 4 and of spiral rib 15 which it carries is so selected that, whatever the angular position of knob 4 and of rib 15, a portion 15*a* of the latter is always in contact with one of teeth 6 of rack 5, while portion 15*b* of the rib, which is diametrically opposite portion 15*a*, is located above the plane passing through the crests of teeth 6. In the particular position shown in FIGS. 1 to 3, rib 15 cooperates with teeth 6 of rack 5 with its two portions 15*a* and 15*c* which are located in the region in which there is overlap between the inner and the outer spiral portions. This overlap is provided in order to assure continuity of motion.

From the preceding description, it will be understood that, if knob 4 and spiral rib 15 are rotated in a clockwise direction, as shown by arrow f in FIG. 1, the outer and inner portions 15*a* and 15*c* of spiral rib 15 progressively push to the right teeth 6 of rack 5 with which they are in contact, causing continuous translational movement of the rack to the right. When the outer portion 15*a* of rib 15 escapes from teeth 6, the movement continues to be assured only by portion 15*b*, which is located above the teeth.

Rotational movement of knob 4 and rib 15 in the opposite, i.e., counterclockwise, direction causes rib 15 to abut, by its spiral inner face, against successive teeth 6, causing translational movement of rack 5 toward the left.

Figure 4:
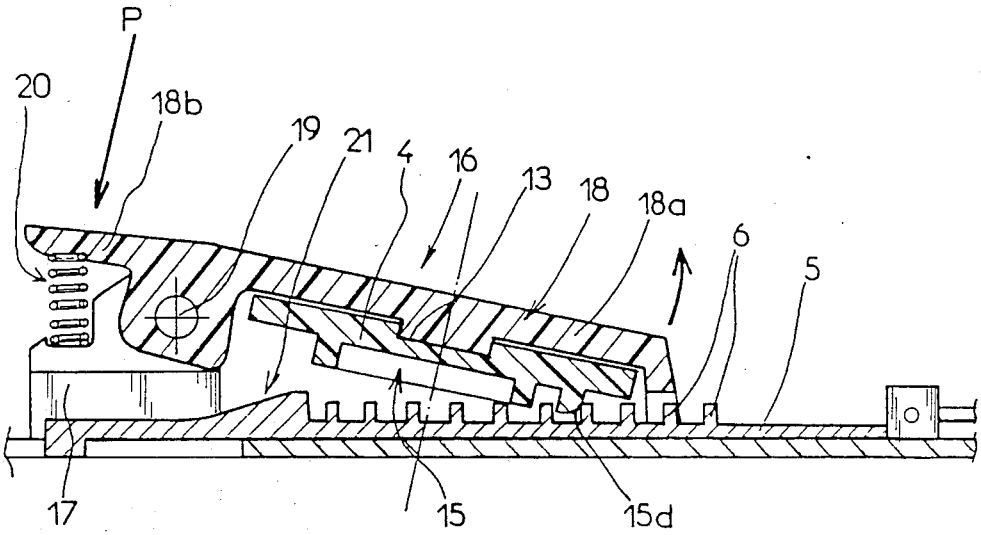
FIG. 4 is a vertical and longitudinal section view of a second embodiment enabling rapid loosening of the device.

In the embodiment illustrated by FIG. 4, housing 16 is formed in two parts, i.e., a base 17 in the shape of a cap attached to element 1, and a cover 18 articulated to base 17 about a horizontal and transverse axis 19. Cover 18 carries, on its inner face, the projection 13 constituting the pivot for control knob 4 provided with spiral rib 15. Cover 18 is drawn by a spring 20, e.g., a compression spring, so as to pull rib 15 against rack 5.

Cover 18 preferably constitutes a two-branched lever located on either side of articulation axis 19, the large branch 18*a* carrying control knob 4, and the small opposite branch 18*b* being subjected to the action of compression spring 20. As a result, if pressure is applied to the small branch 18*b* of cover lever 18, in the direction of arrow P, the assembly of cover 18 is caused to pivot in counterclockwise direction about axis 19, thereby disengaging rib 15 from the tooth 6 of rack 5, with which it was previously engaged. Rack 5 can then be made to slide freely enabling rapid untightening of the device.

In order to facilitate reengagement of rack 5, an access ramp 21 can be provided at its left end, i.e., the one which is first presented when the rack is introduced into housing 16. Ramp 21 comes into contact with the lowest end portion 15*a* of rib 15, whereby ramp 21 causes lifting of the latter, of control knob 4 and of cover 18, permitting the engagement of rack 5 in housing 16.

To facilitate the engagement of rack 5 in housing 16, it is also possible to provide rib 15 along its lower external turn with a rounded entry shape 15*d* against which access ramp 21 glides.

What is claimed is:

1. Device for progressive adjustment of the relative positions of first and second elements to control the tension of a connecting element, comprising (a) a support (3; 16) solid with said first element (1) and comprising a cap shaped base (17) on which is articulated, about a horizontal and transverse axis, a cover (18) in the form of a lever having large and small branches (18*a*, 18*b*), (b) a rack (5) having a succession of teeth (6) of constant pitch (a), solid with said second element (2) and engaged in said support (3; 16); and (c) a control knob (4) rotatably mounted on said support (3; 16) on a lower face of said large branch (18*a*) above said rack (5) and having, on its lower face turned toward said rack (5) a spiral rib (15) centered on the rotational axis (xx') of said control knob (4), said control knob being biased by spring means (20) such that a portion of said spiral rib (15) is selectively engaged and disengaged between said teeth (6) of said rack (5) by pivoting movement of said cover, said spiral rib extending over an arc of at least 360° and having a spacing between its turns substantially equal to the spacing between said teeth (6);

(d) said rotational axis (xx') being inclined, relative to the plane of said rack, at an angle such that, in all angular positions of said spiral rib (15), a small portion (15*a*) only of the latter is engaged between successive teeth of said rack (5), while a diametrically opposite portion of said spiral rib is located above a plane passing through the crests of said teeth (6) of said rack.

2. Device according to claim 1, wherein said rack (5) has at one of its ends a flange (7) sliding in a slot (8) in said first element (1) and abutting against an end of said slot so as to limit the path of travel of said rack.

3. Device according to claim 1, wherein said control knob has a peripheral knurled surface (14) projecting laterally from said support (3; 16).

4. Device according to claim 1, wherein said support (3) has an upper wall (12) whose lower face, inclined with respect to the plane of said rack (5), has a central projection (13) acting as a pivot for said control knob (4).

5. Device according to claim 1, wherein said support (3) has in its central portion a recess (9) in which said control knob (4) is mounted, said recess communicating with the exterior through openings (10, 11) through which said rack (5) passes longitudinally.

6. Device according to claim 1, wherein said spring means comprises a compression spring acting on said small branch (18*b*) of said cover (18).

7. Device according to claim 1, wherein said rack (5) has an access ramp (21) at an end by which it is engaged in said support (16), on which ramp slides a rounded edge portion (15*d*) of said spiral rib (15).

8. Device according to claim 1, wherein said spiral rib (15) comprises more than one complete spiral.

* * * * *